US008989351B2

(12) United States Patent
Vogtmeier et al.

(10) Patent No.: US 8,989,351 B2
(45) Date of Patent: Mar. 24, 2015

(54) X-RAY SOURCE WITH A PLURALITY OF ELECTRON EMITTERS

(75) Inventors: Gereon Vogtmeier, Aachen (DE); Wolfgang Chrost, Hamburg (DE)

(73) Assignee: Koninklijke Philips N.V., Eindhoven (NL)

( * ) Notice: Subject to any disclaimer, the term of this patent is extended or adjusted under 35 U.S.C. 154(b) by 315 days.

(21) Appl. No.: 13/266,478

(22) PCT Filed: May 12, 2010

(86) PCT No.: PCT/IB2010/052107

§ 371 (c)(1),
(2), (4) Date: Oct. 27, 2011

(87) PCT Pub. No.: WO2010/131209

PCT Pub. Date: Nov. 18, 2010

(65) Prior Publication Data

US 2012/0057669 A1 Mar. 8, 2012

(30) Foreign Application Priority Data

May 12, 2009 (EP) ..... 09159977

(51) Int. Cl.
*H05G 1/56* (2006.01)
*H01J 35/14* (2006.01)
(Continued)

(52) U.S. Cl.
CPC ..... *H01J 35/06* (2013.01); *H01J 35/14* (2013.01); *H01J 2235/062* (2013.01); *H01J 2235/068* (2013.01); *H01J 2235/086* (2013.01)
USPC ..... 378/122; 378/115; 378/137; 378/210

(58) Field of Classification Search
CPC ..... H01J 35/065; H01J 29/481; H01J 29/485; H01J 31/06; H01J 29/04; C01B 31/00
USPC ..... 378/4, 91, 98.6, 101, 113, 119, 122, 378/134, 136, 137, 210; 250/423 R, 423 F, 250/493.1, 494.1, 503.1, 526; 315/39.63; 313/421, 426–428, 441, 446–449, 452, 313/293, 296–300, 302, 304, 310, 336, 313/346 R
See application file for complete search history.

(56) References Cited

U.S. PATENT DOCUMENTS 3,482,096 A * 12/1969 Grundhauser et al. ..... 378/92
5,173,852 A 12/1992 Lonn
(Continued)

FOREIGN PATENT DOCUMENTS

EP 0440532 A1 8/1991
JP 6304024 A 2/1988
(Continued)

OTHER PUBLICATIONS

Yue, G. Z., et al.; Generation of continuous and pulsed diagnostic imaging x-ray radiation using a carbon-nanotube-based field-emission cathode; 2002; Applied Physics Letters; 81(2)355-358.

*Primary Examiner* — Anastasia Midkiff

(57) ABSTRACT

The invention relates to an X-ray source (100) with an electron-beam-generator (120) for generating electron beams (B, B') that converge towards a target (110). Thus the spatial distribution of X-ray focal spots (T, T') on the target (110) can be made denser than the distribution of electron sources (121), wherein the latter is usually dictated by hardware limitations. The electron-beam-generator (120) may particularly comprise a curved emitter device (140) with a matrix of CNT based electron emitters (141) and an associated electrode device (130).

23 Claims, 3 Drawing Sheets

(51) Int. Cl.
*H01J 35/30* (2006.01)
*H01J 35/06* (2006.01)

(56) References Cited

U.S. PATENT DOCUMENTS

| | | | | |
|---|---|---|---|---|
| 5,224,143 | A | 6/1993 | Dumitrescu et al. | |
| 5,303,281 | A * | 4/1994 | Koller et al. | 378/134 |
| 5,796,211 | A * | 8/1998 | Graebner et al. | 315/3.5 |
| 6,283,812 | B1 * | 9/2001 | Jin et al. | 445/24 |
| 6,297,592 | B1 * | 10/2001 | Goren et al. | 315/3.5 |
| 6,504,292 | B1 * | 1/2003 | Choi et al. | 313/310 |
| 6,538,367 | B1 * | 3/2003 | Choi et al. | 313/309 |
| 6,553,096 | B1 * | 4/2003 | Zhou et al. | 378/122 |
| 6,760,407 | B2 * | 7/2004 | Price et al. | 378/122 |
| 6,850,595 | B2 | 2/2005 | Zhou et al. | |
| 6,912,268 | B2 | 6/2005 | Price et al. | |
| 7,192,031 | B2 | 3/2007 | Dunham et al. | |
| 7,203,269 | B2 | 4/2007 | Huber et al. | |
| 7,263,156 | B2 | 8/2007 | Roberts et al. | |
| 7,333,587 | B2 | 2/2008 | De Man et al. | |
| 7,359,484 | B2 * | 4/2008 | Qiu et al. | 378/122 |
| 8,125,878 | B2 * | 2/2012 | Jiang et al. | 369/173 |
| 2002/0094064 | A1 | 7/2002 | Zhou et al. | |
| 2003/0002628 | A1 | 1/2003 | Wilson et al. | |
| 2003/0131795 | A1 | 7/2003 | Karasawa et al. | |
| 2004/0146143 | A1 * | 7/2004 | Price et al. | 378/119 |
| 2005/0135550 | A1 | 6/2005 | De Man et al. | |
| 2006/0018432 | A1 | 1/2006 | Zhou et al. | |
| 2007/0009081 | A1 | 1/2007 | Zhou et al. | |
| 2009/0022264 | A1 | 1/2009 | Zhou et al. | |
| 2011/0051895 | A1 * | 3/2011 | Vogtmeier et al. | 378/92 |

FOREIGN PATENT DOCUMENTS

| | | | |
|---|---|---|---|
| JP | 2008168039 | A | 7/2008 |
| JP | 2009087633 | A | 4/2009 |

* cited by examiner

X-RAY SOURCE WITH A PLURALITY OF ELECTRON EMITTERS

FIELD OF THE INVENTION

The invention relates to an X-ray source comprising a target bombarded with electron beams for generating X-rays. Moreover, it comprises an X-ray imaging device with such an X-ray source and a method for generating X-rays.

BACKGROUND OF THE INVENTION

Classical X-ray sources that are used for example in medical X-ray diagnostics comprise a heated cathode for emitting electrons towards an anode, where the bombardment with electrons generates X-ray beams. Moreover, the U.S. Pat. No. 6,912,268 B2 describes an X-ray source with a single "cold cathode" that has a curved surface from which electrons are emitted such that they converge onto the associated anode.

SUMMARY OF THE INVENTION

Based on this background it was an object of the present invention to provide means that allow a versatile X-ray generation, particularly with respect to the spatial origin (focal spot) of X-ray beams.

This object is achieved by an X-ray source comprising a target for emitting X-rays upon bombardment with an electron beam and an electron-beam-generator with at least two electron-beam sources for selectively emitting electron beams that converge towards the target, a method for generating X-rays, comprising emitting electron beams selectively from at least two different electron-beam sources of an electron-beam-generator, focusing said electron beams in a convergent manner onto a target, and an X-ray imaging device particularly a CT, μCT, material analysis, baggage inspection, or tomosynthesis device, comprising an X-ray source comprising a target for emitting X-rays upon bombardment with an electron beam and an electron-beam-generator with at least two electron-beam sources for selectively emitting electron beams that converge towards the target. Preferred embodiments are disclosed in the dependent claims.

According to its first aspect, the invention relates to an X-ray source for generating beams of X-rays that can for example be used in medical or industrial imaging applications. The X-ray source comprises the following components:

a) A target for emitting X-rays if it is bombarded with an electron beam. Suitable designs and materials for such a target are well known to a person skilled in the art and comprise for example tungsten electrodes. As the target will usually be connected to a positive electrical potential during operation, it will in the following sometimes also be referred to as the "anode".
b) An electron-beam-generator with at least two electron-beam sources for selectively emitting electron beams that converge toward the aforementioned target. The electron-beam sources may be any kind of device that is capable of emitting a directed electron beam. Particular embodiments will be described below in more detail.

The regions from which the considered two electron-beam sources emit electron beams have some first spatial distance that is given by design. Moreover, the target points where the emitted electron beams hit the target have a second spatial distance from each other (wherein the target "points" are appropriately defined, e.g. as the centre of gravity of a region hit by an electron beam). The convergence of the electron beams can then be restated as the condition that the first distance (of electron-beam sources) is larger than the second distance (of target points on the target).

It should be noted that the X-ray source usually comprises additional components that are well known to a person skilled in the art and therefore not explicitly mentioned above. Such components comprise for example a power supply providing the necessary energy, and a controller for controlling the electron-beam-generator, e.g. by selectively switching the activation of different electron-beam sources.

One advantage of the described X-ray source is that the X-ray emission can be controlled in a very flexible manner by controlling the individual electron-beam sources correspondingly. Switching activity from one electron-beam source to another allows for example to make the focal spot of X-ray emission jump without a need for a (slow) movement of mechanical components. A further advantage is that the distance of the aforementioned jump can be made smaller than the distance between the associated (switched) electron-beam sources, because the electron beams converge. The convergence of the electron beams hence helps to overcome limitations that are dictated by hardware constraints. As a consequence, the spatial resolution that can be achieved with the X-ray source is higher than the feasible spatial resolution of electron-beam sources.

The invention further relates to a method for generating X-rays, said method comprising the following steps:

a) Selectively emitting electron beams from at least two different electron-beam sources of an electron-beam-generator.
b) Focusing said electron beams in a convergent manner onto a target.

The method comprises in general form the steps that can be executed with an X-ray source of the kind described above. Therefore, reference is made to the preceding description for more information on the details, advantages and improvements of that method.

In the following, further embodiments of the invention will be described that relate to both the X-ray source and the method described above.

In general, the electron-beam sources as well as their target points on the anode may be distributed arbitrarily in space. Usually, there will however be some order or structure in the locations of target points that corresponds to the particular needs of an intended application. In a preferred embodiment, the target points of the electron-beam sources on the target ("anode") lie on at least one given trajectory, wherein the term "trajectory" shall generally denote a one-dimensional line or curve. X-ray beams can then selectively be emitted from locations along said trajectory, which is for example needed in a Computed Tomography (CT) scanner. In many cases the trajectory will simply correspond to a straight line.

In the aforementioned embodiment, the mutual distance of two neighboring target points of electron beams on the trajectory is preferably smaller than the distance of neighboring electron-beam sources. The convergence of electron beams is thus exploited to generate a trajectory of densely packed target points, allowing for example the generation of X-ray images with high spatial resolution.

The electron-beam-generator can in general be any device that is capable to emit at least two directed electron beams. In a preferred embodiment, the electron-beam-generator comprises the following two main components:

a) An "emitter device" with an array of electron emitters, i.e. units at which electrons can leave a material and enter the adjacent (usually evacuated) space as free electrons. An electron emitter will usually be operated as a cathode to provide the appropriate electrical fields and energy (work function) for electron emission.

b) An "electrode device" with an array of electrode units for selectively directing electron beams emitted by the emitter device. With the help of the electrode units, to which an appropriate electrical potential is usually applied during operation, the emission of the electron emitters can be formed into well-defined and properly directed beams. Typically electrode units and electron emitters are assigned to each other in a one-to-one manner.

Preferably, the electron emitters are "cold cathodes" that comprise for example carbon nanotube (CNT) materials. Carbon nanotubes have been shown to be excellent electron emitting materials which allow fast switching times with a compact design. Thus it is for example possible to build X-ray sources with multiple cathodes and/or stationary CT scanners. More information on carbon nanotubes and X-ray sources that can be built with them can be found in literature (e.g. US 2002/0094064 A1, U.S. Pat. No. 6,850,595, or G. Z. Yue et al., "Generation of continuous and pulsed diagnostic imaging x-ray radiation using a carbon -nanotube-based field-emission cathode", Appl. Phys. Lett. 81(2), 355-8 (2002)).

According to a preferred embodiment of the invention, the electron emitters of the above-mentioned emitter device are disposed on a curved surface. As the emitted electrons will tend to move perpendicularly to the emission surface, such a curvature helps to generate convergent electron beams.

One function of the above-mentioned electrode units in the electrode device will be the guidance/collimation of electrons emitted by the emitter device. In the most simple case, electrons will travel along a straight line from the corresponding electron emitter through an electrode unit to their target point at the anode. In another embodiment, the electrode unit may however be designed to deflect electron beams. Electrons coming from an electron emitter will then change their direction due to the influence of the electrode units. Thus the electrode units can be used to make initially parallel (or even divergent) electron beams coming from the electrode device convergent on their further way to the target.

The electrode units of the above electrode device may particularly be disposed in a curved plane. Such a curvature in their arrangement can for instance be used to generate the aforementioned deflection of electron beams.

It was already mentioned that the electron-beam sources of the electron-beam-generator may in general be arbitrarily arranged in space. The same holds for the electron emitters of the above-mentioned emitter device. In a preferred embodiment, the electron-beam sources and/or the electron emitters are however arranged in a two-dimensional array. In this context, the term "array" shall denote an arbitrary arrangement of units in a planar or a curved plane, wherein the two-dimensionality of the arrangement additionally requires that not all units lie on a common line. Arranging electron-beam sources or electron emitters in a two-dimensional array has the advantage that such an arrangement can readily be realized on the surface of some device (e.g. of a substrate) and that the available space on this surface is optimally exploited.

In a further development of the aforementioned embodiment, the array of electron-beam sources or electron emitters has a matrix pattern (which by definition consists of substantially parallel columns each comprising a plurality of "units", i.e. electron -beam sources or electron emitters). Furthermore, the units in neighboring columns of this matrix pattern shall be shifted in the direction of the column with respect to each other. Hence, the "rows" of the matrix become inclined.

In the aforementioned case, it is preferred that the units of at least two different columns of the matrix pattern are focused onto the same (one-dimensional) trajectory on the target. In this way the sets of target points that are associated with different columns are combined in one single trajectory on the target, which has the advantage that, due to the shift, the distance between neighboring target points on this trajectory is smaller than the distance between neighboring units in one column.

According to another embodiment of the invention, the target points of at least two electron-beam sources coincide on the target. In this case the power of two electron-beam sources can be combined to generate X-ray emission from a single location (focal spot) on the target.

In many cases the surface of the target onto which the electron beams impinge will simply be flat. In an optional embodiment of the invention, the surface of the target that is hit by the electron beams may however be curved. This curvature may help to achieve a desired direction of the resulting X-rays.

The invention further relates to an X-ray imaging device comprising an X-ray source of the kind described above, i.e. an X-ray source with a target for emitting X-rays upon bombardment with electron beams and an electron-beam-generator with at least two electron-beam sources for selectively emitting electron beams that converge towards the target. The imaging device may particularly be a CT (Computed Tomography), μCT, material analysis (e.g. industrial or scientific), baggage inspection, or tomosynthesis device. Furthermore, the imaging device will typically comprise a detector for detecting X-rays after their interaction with an object and data processing hardware for evaluating the measurements and for reconstructing the images.

BRIEF DESCRIPTION OF THE DRAWINGS

These and other aspects of the invention will be apparent from and elucidated with reference to the embodiment(s) described hereinafter. These embodiments will be described by way of example with the help of the accompanying drawings in which.

Like reference numbers or numbers differing by integer multiples of 100 refer in the Figures to identical or similar components.

DESCRIPTION OF PREFERRED EMBODIMENTS

The use of carbon nanotube (CNT) based field emitters enables the design of distributed X-ray sources for applications in the field of medical imaging. A CNT based X-ray source may include a substrate with the emitter structure and on top of the emitter a focusing unit that consists of one, two or more focusing electrodes. To get a linear array of these CNT based emitters, the placement of emitter and focusing element (e.g. hole in the electrode on top of the emitting center of the substrate) may be done with a certain pitch in one or two dimensions. As result a one-dimensional array or two-dimensional array of electron-beam sources is established that selectively emit the electron beam onto a fixed (or maybe even a rotating) anode.

To achieve a high spatial resolution of the generated images, the CNT emitters of different columns may be placed with an offset (e.g. 1/4 pixel offset), thus allowing a higher resolution focal spot point pitch of the resulting X-ray beam from the anode.

In the described approach, the two-dimensional arrangement of the emitters causes the position of the focal spots (target areas of the electron beams) on the anode to be at different positions. This leads to different focal spot positions and sizes of the resulting X-ray beams; furthermore, also the distances from focal spot to object vary depending on the used CNT emitter. For a high resolution sampling of an object it is however desirable to have all X-ray focal spots on a line or at clearly defined positions on one or two lines. With parallel electron beams, it is not possible to achieve this.

To address this problem, it is proposed to design an X-ray source in which electron beams generated by an electron-beam-generator converge towards a target. In this way, minimal distances between electron sources that are prescribed by hardware limitations can be complied with while simultaneously a denser arrangement of focal spots of X-ray beams can be achieved on the anode.

Figure 1:
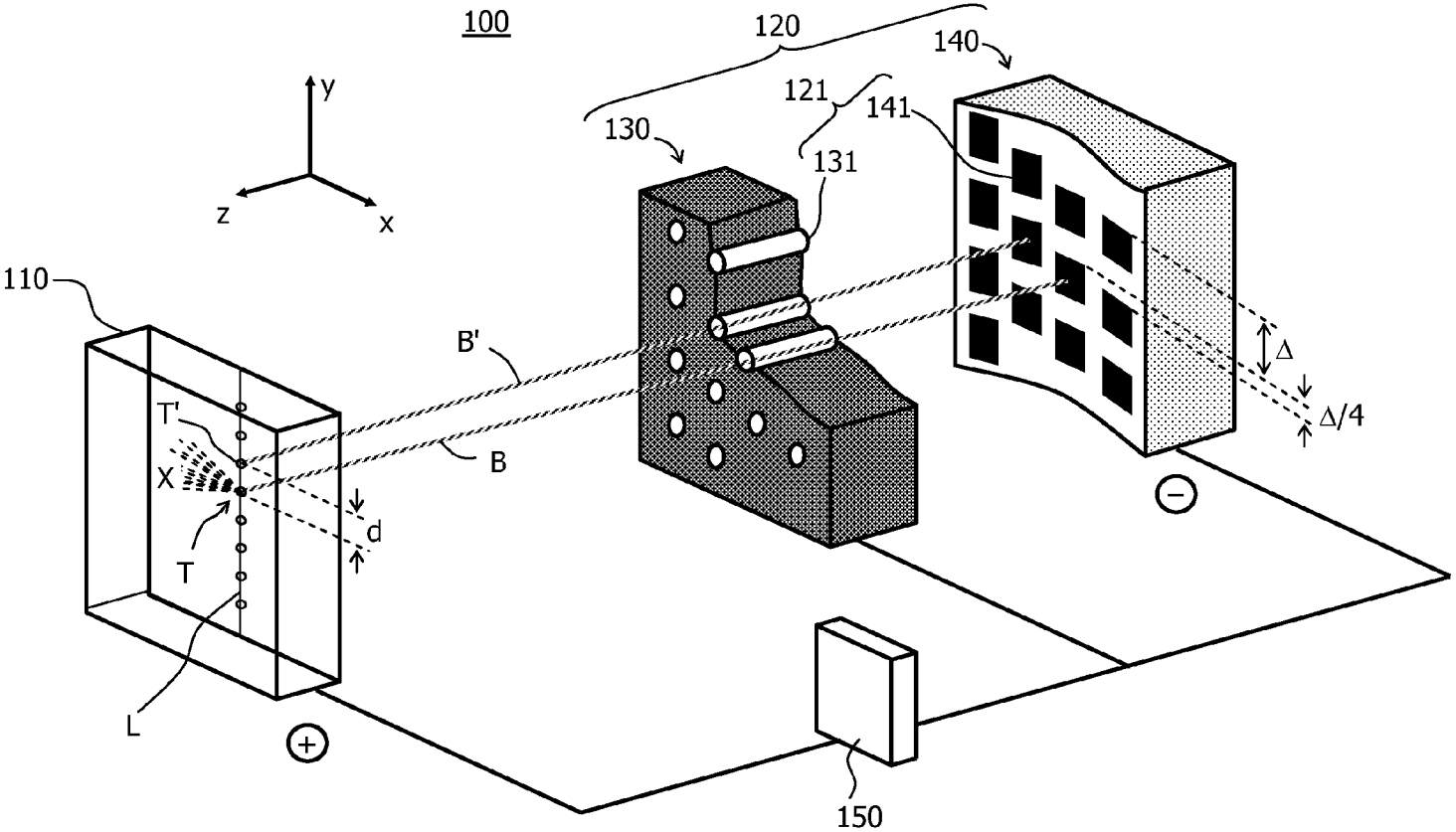
FIG. 1 schematically shows a perspective view of a first X-ray source according to the present invention.

FIG. 1 schematically illustrates in a perspective view a first X-ray source 100 that is designed according to the aforementioned principle. The X-ray source 100 comprises the following components:

1. A target 110, which may be realized by a plate or substrate of a suitable metal like a tungsten alloy. When the target is hit by an electron beam B in a target point T, a beam of X-rays X will be emitted. During operation, the target 110 is usually on a positive electrical potential provided by a controller 150. It is therefore synonymously called "anode" in the following.
2. An electron-beam-generator 120 with electron-beam sources 121 for generating electron beams B, B' that converge towards the anode 110. In the shown embodiment, the electron-beam-generator comprises two sub-components, namely:

2.1 An electrode device 130, realized by a (planar or curved) conductive substrate comprising an array of holes 131 through which electron beams B, B' can pass. During operation, the electrode device 130 is supplied by the controller 150 with a potential that is chosen appropriately to achieve the desired collimation and/or deflection of electrons. The electrode device might also consist of two or more electrodes.

2.2 An emitter device 140, here realized by a curved substrate with a surface on which electron emitters 141 are arranged in an matrix pattern. During operation, the electron emitters 141 can selectively (i.e. individually) be supplied with a (negative) potential by the controller 150 to make them emit electrons. Usually only one electron emitter 141 is activated at a time. The electron emitters 141 may particularly be based on carbon nanotubes (CNT).

Figure 2:
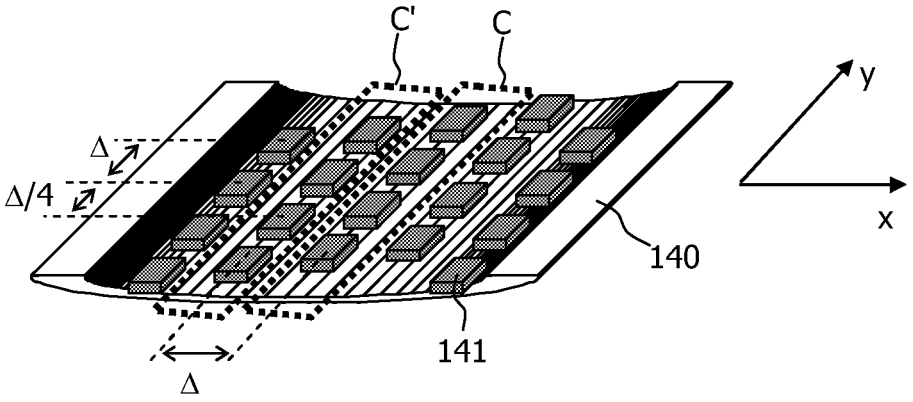
FIG. 2 separately shows the emitter device of the X-ray source of FIG. 1.

Due to the concave curvature of the surface of the emitter device 140 that carries the electron emitters 141, the electron beams emitted from different columns C, C' of the matrix pattern converge onto a single, one-dimensional trajectory L on the target 110. FIG. 2 shows in this respect in a separate view of the emitter device 140 the columns C, C' of electron emitters 141. Said electron emitters 141 have a distance Δ from each other that cannot be reduced further due to hardware limitations. If all electron emitters 141 would emit parallel electron beams, the associated target points on the anode would have the same mutual distances Δ, which would limit the spatial resolution that could be achieved with such an X-ray source. To overcome this limitation, the electron emitters 141 in neighboring columns C, C' are shifted in column direction (y-direction) with respect to each other. In FIG. 2, the shift corresponds to a quarter of the distance Δ. As the electron beams B, B' emitted from the columns C, C' all converge to the same trajectory L on the anode 110, the resulting distance d between target points T, T' on said trajectory L is Δ/4, too. Hence the convergence of the electron beams allows for a considerably closer spacing of focal spots on the target anode than would be possible with parallel electron beams.

The convergence of electron beams may be achieved with a curved substrate 140 for the emitter array as well as a curved geometry for the focusing electrode 130, such as the focusing electrode 230 shown in F*igure* 4. As shown in F*igure* 3, the focal spot point from all five (or more) columns C, C' of emitters 141 are on one focal spot line L on the anode 110 with a minimum pitch in y-direction. This allows a high spatial resolution sampling due to the ¼ pitch of the resulting focal spot positions on the anode line.

Figure 3:
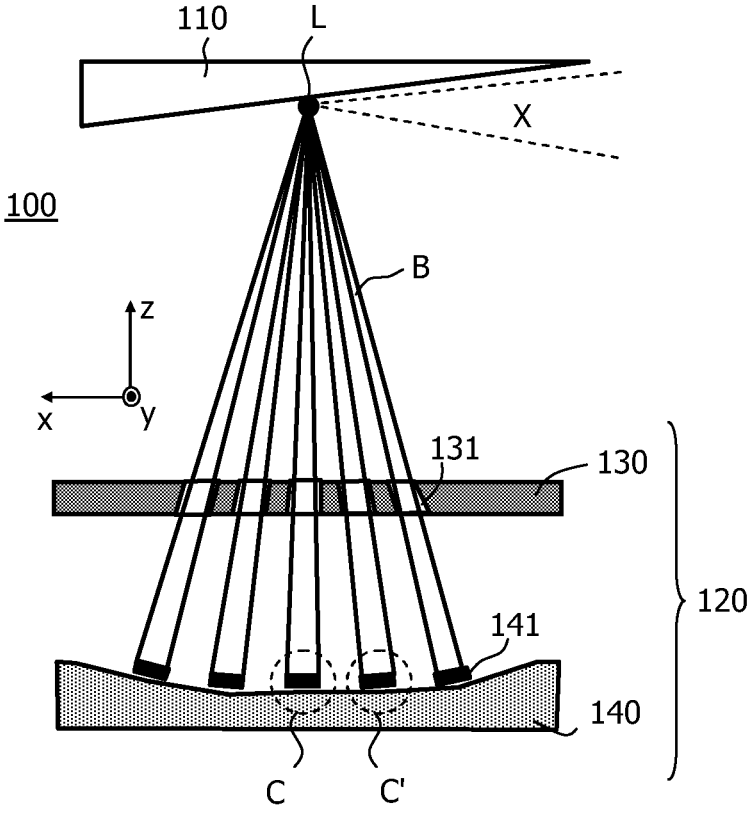
FIG. 3 shows schematically a top view onto the X-ray source of FIG. 1.

FIG. 3 also illustrates that it is necessary to distinguish between the convergence of several electron beams B with respect to each other (which was the subject of the above considerations) and an "internal" convergence of a single electron beam B. Due to the "internal convergence", each electron beam B has some "magnification", which is defined by the ratio of beam cross-sections at the electron emitter 141 and the target spot, respectively. A typical size of the (e.g. CNT) emitter 141 may for example be 2 mm×1 mm. A "magnification" of 10 due to the focusing of the electron beam B would then result in a focal spot size of 200 μm×100 μm. When no overlap between neighboring focal spots is allowed (i.e. desired), this focal spot size limits the minimal pitch of focal spots that can be achieved. In this case the "magnification" of the single electron beams has to be taken into account, too, when the device is designed.

Figure 4:
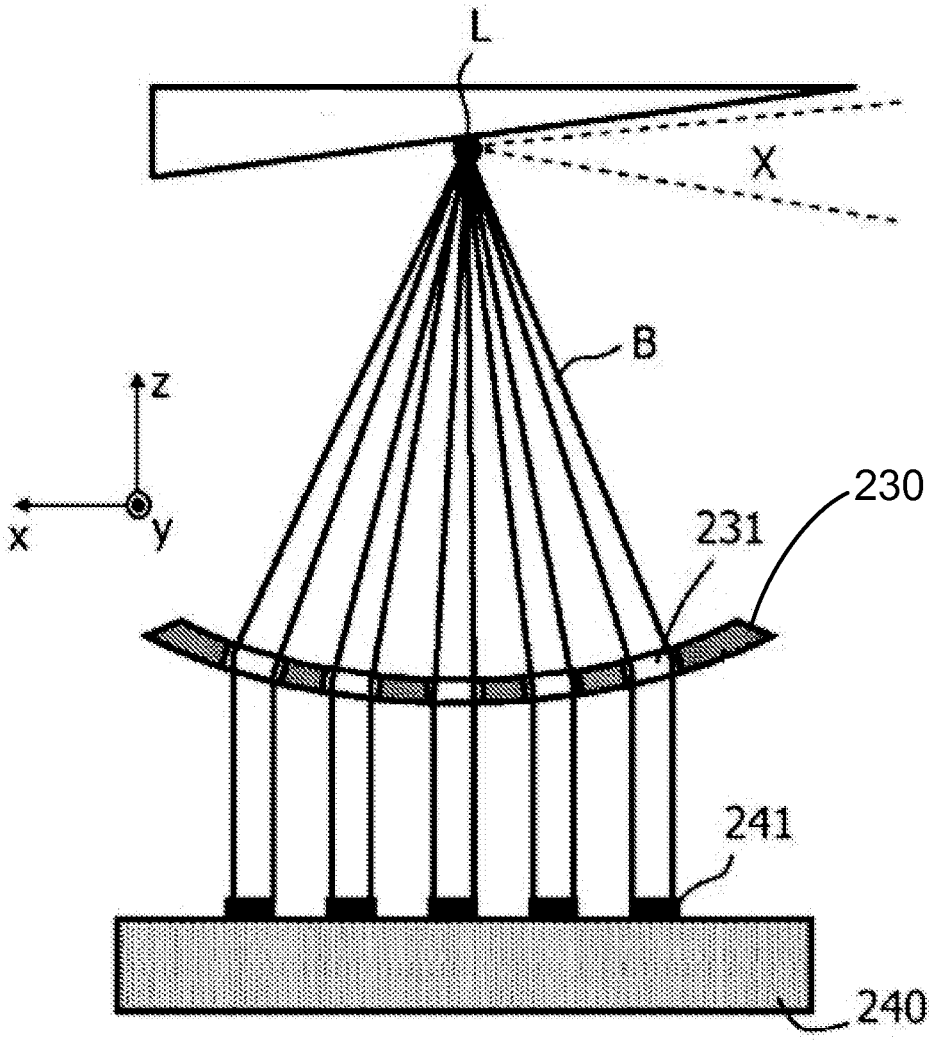
FIG. 4 shows a top view of a second X-ray source according to the invention with a planar electrode device.

The focusing to one line L on the anode 110 could also be done by modified focusing electrodes at the different column positions of the electrodes. FIG. 4 illustrates this for an embodiment in which a flat substrate 240 with electron emitters 241 is used in combination with differently focused electrode holes 231.

Furthermore, different combinations of flat, curved, double curved (and more) substrates, focusing electrodes and anodes are conceivable to achieve the desired positioning of the resulting focal spots on a trajectory (curve).

Also a focusing of electron beams from several different emitters to just one focal spot position is possible. This would be favorable if the intensity limitation is not at the anode material (melting temperature) but on the maximum current from the emitter.

In summary, the invention relates to the use of (e.g. CNT) field emitters in the design of distributed X-ray sources for applications in the field of medical imaging. The design of a CNT based X-ray source includes a substrate with the emitter structure and on top of the emitter a focusing unit that consists of one, two or more focusing electrodes. To achieve a high spatial resolution, an offset placement of the CNT emitters in different columns (e.g. ¼ pixel offset) is used that allows a higher resolution focal spot point pitch of the resulting X-ray beam from the anode. By using convergent electron beams (e.g. produced with a curved substrate for the emitter array as well as a curved geometry for the focusing electrodes, or a flat substrate but special focusing structures), electron beams from different columns can be focused onto one trajectory.

The invention is useful for all high resolution systems with distributed X-ray sources based on e.g. CNT emitter technology, for example tomosynthesis, μCT, CT, material analysis or baggage inspection systems.

Finally it is pointed out that in the present application the term "comprising" does not exclude other elements or steps, that "a" or "an" does not exclude a plurality, and that a single processor or other unit may fulfill the functions of several means. The invention resides in each and every novel characteristic feature and each and every combination of characteristic features. Moreover, reference signs in the claims shall not be construed as emitting their scope.

The invention claimed is:

1. An X-ray source, comprising a target configured to emit X-rays upon bombardment with an electron beam;

an electron-beam-generator with a plurality of electron-beam sources which selectively emit electron beams that converge towards the target on target points along at least one line of a group consisting of one line and two lines along a surface of the target, the electron-beam-generator, comprising:

an emitter device which includes a first substrate and an array of electron emitters arranged on the first substrate, each electron emitter in the array is configured to emit an electron beam; and an electrode device which includes a conductive second substrate, and the conductive second substrate directs each emitted electron beam to one of the target points on the at least one line along the surface of the target;

a controller configured to control the electron-beam-generator by selectively switching activation of each electron emitter, and the controller is configured during operation to provide a positive electrical potential to the target and provide a negative electrical potential to at least one electron emitter of the array of electron emitters, and provide an electrical potential to the electrode device to achieve a predetermined one of a collimation or a deflection of electrons; and wherein the first substrate and the conductive substrate are configured as one of the following ways:

either the first substrate is curved and the second conductive substrate is planar; or, the first substrate is planar and the second conductive substrate is curved.

2. The X-ray source according to claim 1, wherein the conductive second substrate is curved and each emitted electron beam is focused to one of the target points on one line along the surface of the target.

3. The X-ray source according to claim 2, wherein a neighboring target distance between neighboring target points on the one line along the surface of the target is less than a neighboring source distance between neighboring electron-beam emitters on the first substrate, wherein each neighboring target distance is approximately equal, and the neighboring target points on the one line are different.

4. The X-ray source according to claim 1, wherein the electron emitters comprise carbon nanotubes.

5. The X-ray source according to claim 1, wherein the first substrate is curved to focus the emitted electron beams on the target points on the at least one line along the surface of the target.

6. The X-ray source according to claim 1, wherein the arrangement of the array of the electron emitters includes the electron emitters arranged in a plurality of columns and each column includes a plurality of electron emitters and the electron beams emitted by the plurality of columns of the electron emitters are directed to the target points on one line along the surface of the target.

7. The X-ray source according to claim 6, wherein the electron emitters in each column are offset by one fourth of a distance between the electron emitters in an adjacent column and each electron emitter is directed to a different point on the at least one line along the surface of the target.

8. The X-ray source according to claim 1, wherein the array of electron emitters has a matrix pattern with electron emitters of neighboring columns being shifted in column direction with respect to each other.

9. The X-ray source according to claim 8, wherein the electron emitters of at least two different columns focus onto the target points on one line along the surface of the target.

10. The X-ray source according to claim 1, wherein the electron beams of at least five different columns of electron emitters focus on the target points on one line along the surface of the target and each of the five different columns of electron emitters includes a plurality of electron emitters.

11. The X-ray source according to claim 1, wherein the surface of the target, onto which electron beams of the electron-beam-generator impinge, is curved.

12. An X-ray imaging device, selected from one of a CT, μCT, material analysis, baggage inspection, or tomosynthesis device, comprising an X-ray source according to claim 1.

13. A method for generating X-rays, comprising:

emitting electron beams selectively from at least two different electron-beam sources of an electron-beam-generator to target points on at least one line of a group consisting of one line and two lines along a surface of a target, wherein the electron-beam-generator comprises:

an emitter device which includes a first substrate and an array of electron emitters arranged on the first substrate, each electron emitter in the array is configured to emit an electron beam;

an electrode device which includes a conductive second substrate and the conductive second substrate directs each emitted electron beam to one of the target points on the at least one line along the surface of the target; and a controller configured to control the electron-beam-generator by selectively switching activation of different electron-beam sources, and the controller, during an operation, provides a positive electrical potential to the target, provides a negative electrical potential to at least one electron emitter of the array of electron emitters, and provides an electrical potential to the electrode device to achieve a predetermined one of a collimation or a deflection of electrons; and wherein the first substrate and the conductive substrate are configured in one of the following ways:

either the first substrate is curved and the second conductive substrate is planar; or, the first substrate is planar and the second conductive substrate is curved; and focusing, via the controller, said electron beams in a convergent manner onto the target points along the at least one line alon the surface of the target, and the target emits x-rays.

14. The method according to claim 13, wherein the conductive second substrate is curved to focus the electron beams emitted by the electron emitters to hit the target points that lie on one line along the surface of the target.

15. The method according to claim 14, wherein a neighboring target distance between neighboring target points on the one line along the surface of the target is less than a neighboring source distance between neighboring electron emitters on the first substrate, wherein each neighboring target distance is approximately equal, and the neighboring target points on the line are different.

16. The method according to claim 13, wherein the electron emitters comprise carbon nanotubes.

17. The method according to claim 13, wherein the first substrate is curved to deflect the emitted electron beams and the emitted electron beams are focused on the target points on the at least one line along the surface of the target.

18. The method according to claim 13, wherein the arrangement of the array of the electron emitters includes the electron emitters arranged in a plurality of columns, and each column includes a plurality of electron emitters, and the electron beams emitted by the plurality of columns of the electron emitters are focused on the target points on one line along the surface of the target.

19. The method according to claim 18, wherein the electron emitters in each in each column are offset by one fourth of a distance between the electron emitters in an adjacent column and each electron emitter is directed to a different point on the at least one line along the surface of the target.

20. The method according to claim 13, wherein the array of electron emitters has a matrix pattern with the electron emitters of neighboring columns being shifted in column direction with respect to each other.

21. The method according to claim 20, wherein the electron emitters of at least two different columns focus onto the target points on one line along the surface of the target.

22. The method according to claim 13, wherein the electron beams of at least five different columns of electron-beam sources focus on one line along the surface of the target.

23. The method according to claim 13, wherein the surface of the target, onto which electron beams of the electron-beam-generator impinge, is curved.

* * * * *